United States Patent [19]

Eubanks

[11] Patent Number: 4,506,535

[45] Date of Patent: Mar. 26, 1985

[54] DEVICE HAVING POWER MEANS FOR RE-ARCHING OR DE-ARCHING A LEAF SPRING

[76] Inventor: Bobby G. Eubanks, 2074 Battle Rd., Augusta, Ga. 30904

[21] Appl. No.: 446,741

[22] Filed: Dec. 3, 1982

[51] Int. Cl.[3] ..... B21D 31/00

[52] U.S. Cl. ..... 72/389; 72/386; 29/230

[58] Field of Search ..... 29/230; 72/389, 386, 72/384, 212, 453.14; 254/10.5

[56] References Cited

U.S. PATENT DOCUMENTS

| | | | |
|---|---|---|---|
| 1,828,758 | 10/1931 | Zimmerman | 29/230 |
| 2,194,981 | 3/1940 | Marsh | 29/230 |
| 2,591,210 | 4/1952 | Sowell | 29/230 |
| 2,910,108 | 10/1959 | Fike | 72/389 |
| 3,195,339 | 7/1965 | Lang | 72/389 |
| 3,344,635 | 10/1967 | Van Allen | 72/389 |
| 4,254,651 | 3/1981 | Kelly | 72/389 |
| 4,265,106 | 5/1981 | McMaster et al. | 72/389 |

*Primary Examiner*—Daniel C. Crane
*Assistant Examiner*—David B. Jones
*Attorney, Agent, or Firm*—Patrick F. Henry

[57] ABSTRACT

A frame having a U-shaped member which is placed over and around a leaf spring to be re-arched while still on a vehicle; a platform pivotally mounted on the U-shaped member, a hydraulic jack supported on the platform so that the ram or piston rod on the jack may be hydraulically forced against a bending member which comprises a pair of spaced spring contact members located on opposite sides of the U-shaped member and on the opposite side of the spring therefrom. The device may be assembled over a spring and hydraulic pressure applied to drive the contact members to create a bending moment about a round surface on the inside face of the top of the U-shaped member. The pressure may be reversed to de-arch the spring.

13 Claims, 3 Drawing Figures

DEVICE HAVING POWER MEANS FOR RE-ARCHING OR DE-ARCHING A LEAF SPRING

BACKGROUND OF THE INVENTION

1. Field of the Invention

The field of the invention is that of metal working assembling and disassembling apparatus and particularly valve applying and removing for leaf spring and also pushing and pulling implements employing hydraulic jacks. Class 254, subclass 10.5 and Class 29, subclass 230 are believed to be relevant.

2. Prior Apparatus and Procedures

The known prior devices for bending leaf springs and similar items while still on a vehicle does not include the present arrangement which can be produced and sold at a reasonable price to various establishments such as auto body shops, auto alignment shops, wheel and axle shops and service stations. Prior devices include machines such as hydraulic presses which are used in machine shops wherein the spring or leaf components of the spring are placed in machinery jigs or the like but not on the spring while still mounted on the vehicle. The present device solves a long existing problem of how to re-arch or search leaf springs on vehicles without removal from the vehicle.

The following prior U.S. patents are noted:

U.S. Pat. No. 1,828,758
U.S. Pat. No. 1,962,002
U.S. Pat. No. 2,194,981
U.S. Pat. No. 2,259,533
U.S. Pat. No. 2,591,210.

SUMMARY OF THE INVENTION

One primary object of this invention is to provide a device for arching or de-arching a leaf spring on a vehicle without removing the leaf spring from the vehicle or disassembling same.

Another object of this invention is to provide the device mentioned in the preceeding paragraph which may be operated in a preferred form through the use of fluid pressure such as hydraulic or pneumatic pressure an an ordinary hydraulic or pneumatic jack.

The device in one form comprises a bending means mounted on one side of the leaf spring and spaced pressure contact means on the other side of the leaf spring to provide a bending moment about said contact means, a power means such as a hydraulic or pneumatic jack supported so that the movable ram or piston thereof provides the power to force the bending members against one side of the leaf spring to bend same about the contact point.

Other and further objects and advantages of this invention will become apparent upon reading the following description of the preferred embodiment taken in conjunction with the accompanying drawings.

DESCRIPTION OF A PREFERRED EMBODIMENT

Figure 1:
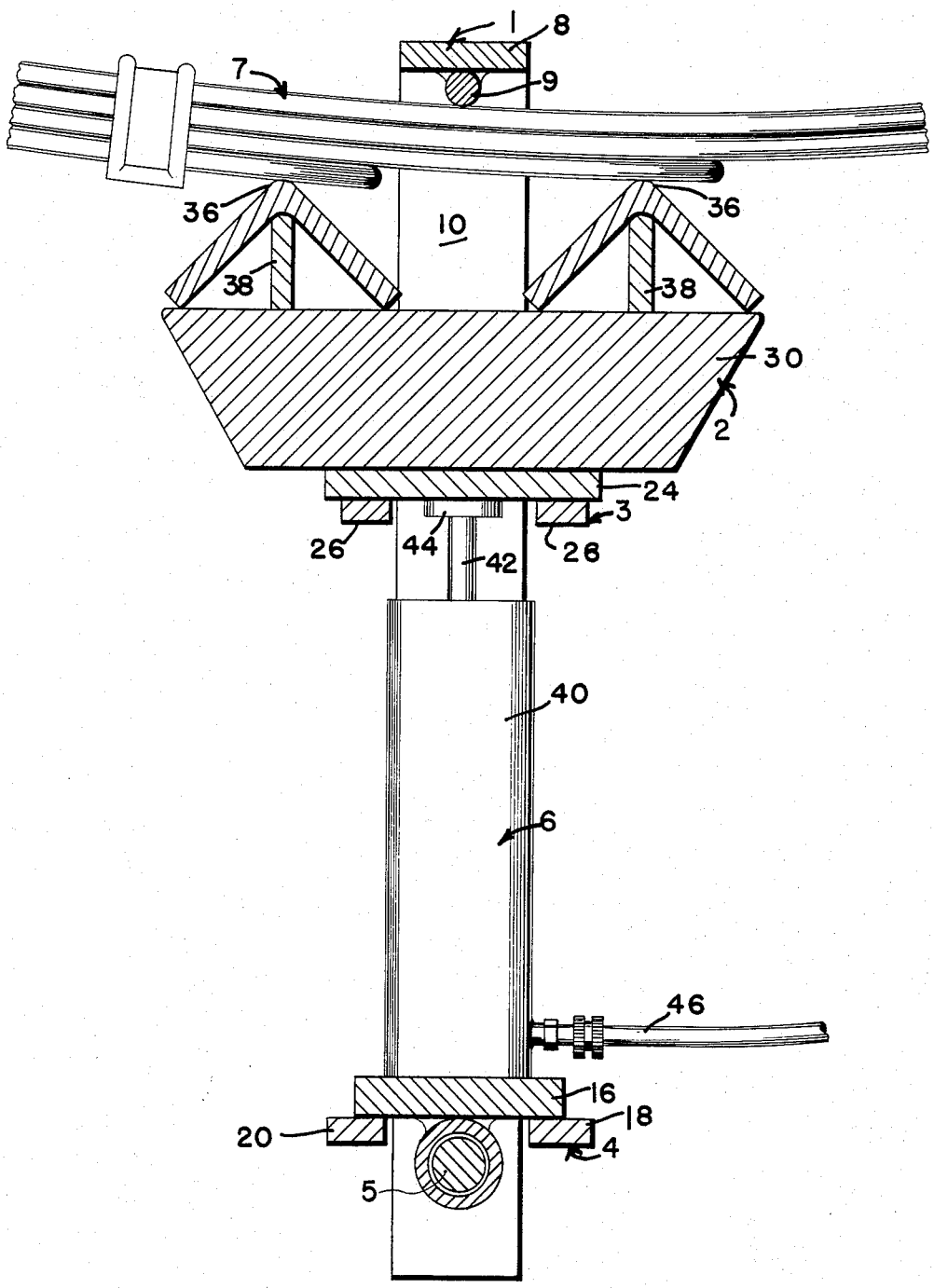
FIG. 1 is a side elevation view partly in cross-section of the present device assembled on a typical leaf spring which has not been removed from the vehicle.

Referring initially to FIG. 1, the present leaf spring archer and de-archer comprises a U-shaped member or frame 1, a heavy bending member 2, and a jack support base 4 which is rotatably attached to the U-shaped member 1 by means of a removable pin or shaft 5. The support base 4 supports a conventional hydraulic jack 6 for operation against the typical auto leaf spring 7.

In more detail and referring to other figures of the drawing, the U-shaped member 1 comprises a top 8 which has a spring contact member 9 on the inside face thereof and the contact member 9 is a circular cylinder or shaft which is welded in place for the purpose of contacting the top of the spring 7 to provide a fulcrum point about which the spring may be re-arched by being bent thereabout. The U-shaped member 1 has elongated sides 10, 12 which provides a space therebetween in which is mounted the bending member 2 and the hydraulic jack 6 which is removably supported in place on the platform 4 by means of the pin or shaft 5 which extends through opposed holes 14 in each of the respective sides 10 and 12. The support platform 4 comprises a heavy metal plate 16 having transverse end plates 18, 20 on the underside thereof and the circular bearing collar 22 through which is mounted the pin or shaft 5 through the holes 14.

The platform 3 for supporting the bending member 2 comprises a base plate 24 and opposed, spaced bottom end plates 26, 28 which are welded thereto. The end plates 26, 28 are positioned outside of the sides 10, 12 respectively of the U-shaped member 1 as are also the end plates 18, 20 of support base 4 in the manner shown in FIG. 1, all for the purpose of stability and proper alignment and maintenance of position whenever the jack 6 is in place.

The bending member 2 is a large heavy block 30 of steel or iron which has inclined ends 32 and a flat top 34 on which is mounted the spring contact members 36 which are of identical construction and comprise angled plates welded into position on top of a support block 38 with the angled plates inverted so that the convex edge is exposed for engagement with the bottom of the spring 7 in the manner shown in FIG. 1.

The conventional hydraulic jack 6 comprises a pressure casing or cylinder 40 and a piston rod or ram 42 on which is mounted a cap 44. The cylinder 40 contains hydraulic fluid under controlled pressure from a hydraulic fluid line 46 which leads from any controlled, pressurized source of hydraulic fluid or pneumatic air pressure as commonly found in service stations, auto repair shops, auto alignment and body shops.

Figure 2:
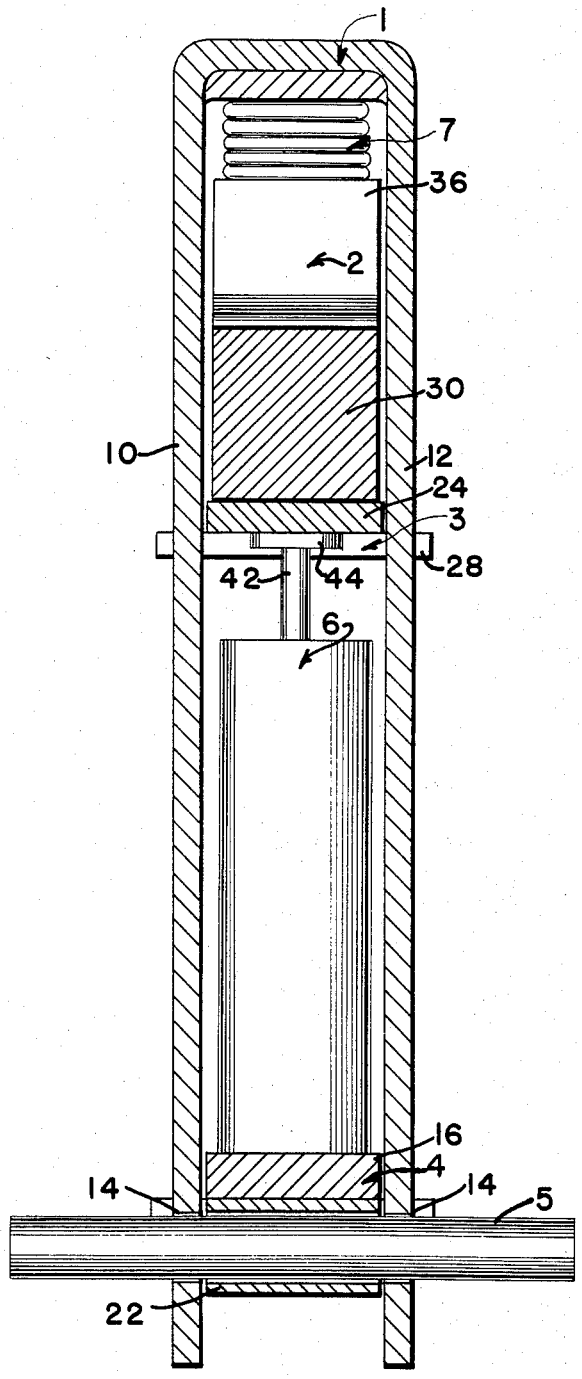
FIG. 2 is an end elevation view of the device shown in FIG. 1.
Figure 3:
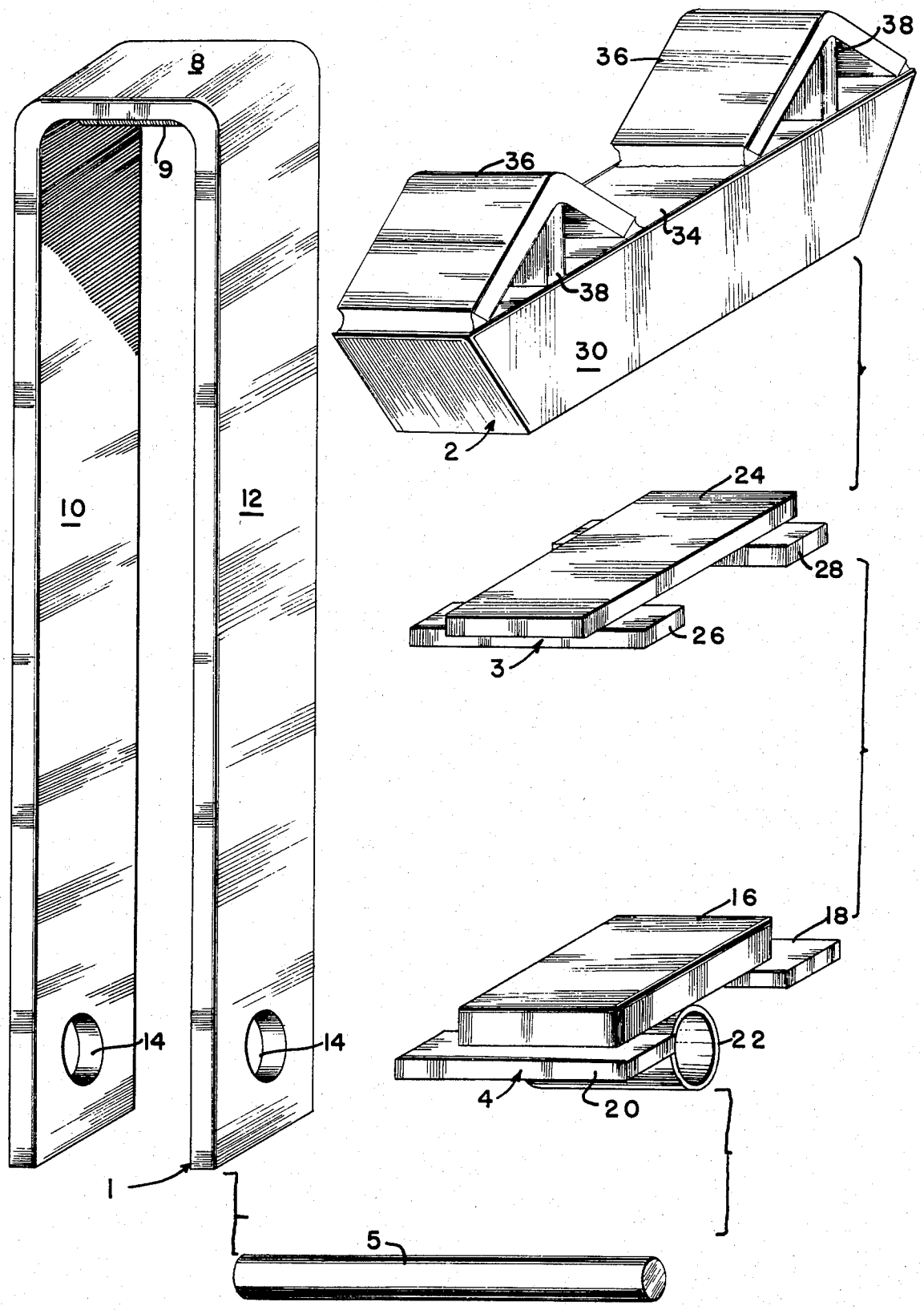
FIG. 3 is a disassembled assembly view of the device shown in FIGS. 1 and 2.

In the operation of the device assembled on the spring in the manner previously described and shown in FIGS. 1 and 2, whenever sufficient hydraulic pressure is applied to the ram 42 the cap 44 will force the bending member 2 in an upwardly direction forcing the convex edges of the respective plates 36 against the bottom of the leaves of the spring 7 and at the same time there is a reaction force which brings the spring contact member 9 into engagement with the top of the leaf spring 7 so that there is a bending moment whereby all of the leaves of the spring 7 are bent carefully and gradually about the spring contact member 9 until the proper amount of re-arching has been accomplished.

To reverse the procedure, that is, to de-arch or flatten rather than arch the spring 7, the U-shaped member 1 is in the same position but the bending member 2 is removed from the position of FIGS. 1 and 2 and inverted and placed on top of the spring 7 with the bottom of the block 30 upside down so that it is contacted by the spring contact member 9 and the platform 3 is removed altogether and not used. A small chain (not shown) is substituted for platform 3 as a safety precaution. The chain is hooked just below spring 7 and around U-shaped member 1 to hold jack 6 in place and preventing jack 6 from dislodging from U-shaped member 1. The cap 44 of the ram 42 contacts the bottom of the spring 7 directly and will cause a bending moment about the cap 44 in a downwardly direction from the apex or convex portion of the plates 36.

While I have shown and described a particular embodiment of this invention together with a suggested mode of operation thereof, this is by way of illustration only because there are various alterations, changes, deviations, eliminations, revisions and departures which may be made in the disclosed embodiment without departing from the scope of my invention as defined only by a proper interpretation of the appended claims.

What is claimed:

1. In a device for re-arching or de-arching a leaf spring:

a contact means for mounting on one side of said leaf spring and having a contact portion thereon, spaced spring contacts for mounting on the opposite side of said spring, removable bending means having said spaced spring contacts thereon for removably supporting said spaced spring contacts in position against said opposite side of said spring and said removable bending means being removable for inversion and repositioning on said spring for de-arching the spring, said removable bending means having a flat, planar bottom thereon contacted but not connected during re-arching to push said removable bending means against said spring and said bottom being inverted against said contact portion when said spring is dearched, said bending means also having a flat, planar top thereon contacted but not connected when said spring is de-arched, power means for power driving against said flat, planar bottom to force said spaced spring contacts against said spring during re-arching and said power means comprising a power member having a flat, planar power member top removably contacting said flat, planar bottom of said removable bending means in only a single plane during re-arching and being repositionable for de-arching a spring by applying power against said spring when said removable bending means is repositioned with the flat, planar bottom thereof against the contact portion of said contact means and with the flat, planar bottom contacted by but not connected to the flat top of the power member, and support means for said power means.

2. The device claimed in claim 1 wherein said contact means is supported on a U-shaped frame member and said spaced spring contacts are mounted within said U-shaped member.

3. The device claimed in claim 1 wherein said power means is mounted on a base and said base is pivotally supported on said U-shaped frame member.

4. The device claimed in claim 2 wherein said removable bending means comprises a bending member having the spaced spring contacts thereon for positioning on opposite sides of said U-shaped member.

5. The device claimed in claim 4 wherein there is a base support means for said bending member, said base support being mounted within said U-shaped frame member.

6. The device in claim 5 wherein said base support means comprises outside members positioned outside said U-shaped member to prevent dislodgement.

7. The device in claim 6 including a jack support on said U-shaped member.

8. The device in claim 7 wherein there is a pin means removably attaching said jack support to said U-shaped member.

9. The device in claim 8 wherein there are members on said jack support positioned outside said U-shaped member.

10. In a device for re-arching or de-arching a leaf spring:

a U-shaped frame support member having a spring contact portion mounted on the top thereof for engagement with one side of a leaf spring, a jack platform pivotally supported in spaced opposed openings near the bottom of said U-shaped member, a removable pivot pin for supporting said jack platform, a second platform removably supported intermediate the U-shaped member, having an upper and a lower flat, planar platform surface, a bending means mounted on said second platform comprising a removable bending member having an upper and a lower flat, planar bending member surface and spaced spring contacts on said upper bending member surface, said bending member lower surface and the upper surface on said second platform contacting one another within only a single plane, said bending member and second platform confined within and across said U-shaped member whereby said spaced spring contacts contact said spring on the side thereof opposite from said contact portion on said top of said U-shaped member thereby providing a bending moment about said contact portion on said U-shaped member when brought into engagement with said leaf spring under pressure for rearching said spring, said bending member being removable and repositionable on the opposite side of said spring with said spaced spring contacts inverted against said spring and said bending member against said spring contact portion, a fluid power means mounted on said bottom platform and having removable fluid power ram having a planar, flat ram surface engageable against said flat planar bending member lower surface to force said spaced spring contacts against said leaf spring to create a bending moment thereby bending said spring about said contact point on the top of said U-shaped member, said flat ram surface being also engageable against said spring when said bending member has been repositioned to de-arch said spring.

11. The device in claim 10 including a pivot means for said fluid power means.

12. The device in claim 11 wherein said pivot means provides support on said U-shaped member for said fluid power means.

13. The device in claim 11 wherein said fluid power means is a fluid power jack.

* * * * *

UNITED STATES PATENT AND TRADEMARK OFFICE

CERTIFICATE OF CORRECTION

PATENT NO. : 4,506,535

DATED : March 26, 1985

INVENTOR(S) : BOBBY G. EUBANKS

It is certified that error appears in the above-identified patent and that said Letters Patent is hereby corrected as shown below:

Column 1, line 26, change "search" to --- dearch ---.

Signed and Sealed this

*Sixteenth* Day of *July 1985*

[SEAL]

*Attest:*

DONALD J. QUIGG

*Attesting Officer* *Acting Commissioner of Patents and Trademarks*